United States Patent [19]

Figlia

[11] 4,028,805

[45] June 14, 1977

[54] CAN OPENER

[75] Inventor: Anthony G. Figlia, Rego Park, N.Y.

[73] Assignee: F. G. Waide, Inc., New York, N.Y.

[22] Filed: Aug. 30, 1976

[21] Appl. No.: 718,766

[52] U.S. Cl. ..... 30/403; 30/405; 30/423

[51] Int. Cl.[2] ..... B67B 7/38

[58] Field of Search ..... 30/401, 403, 405, 423–425

[56] References Cited

UNITED STATES PATENTS

| | | | |
|---|---|---|---|
| 2,692,426 | 10/1954 | Newsom | 30/405 X |
| 2,789,345 | 4/1957 | Klassen | 30/403 |
| 2,853,776 | 9/1958 | Smith | 30/424 X |
| 2,916,817 | 12/1959 | Nordquist | 30/405 X |
| 3,315,352 | 4/1967 | Scott | 30/405 |
| 3,878,604 | 4/1975 | Smith | 30/403 X |

*Primary Examiner*—Gary L. Smith
*Attorney, Agent, or Firm*—Norbert P. Holler

[57] ABSTRACT

An electric motor-driven can opener having a push button-operated switch to close the energization circuit for the motor is disclosed. The can-opening mechanism includes a cutter blade and can-turning gear combination, a vertically reciprocatable slide member supporting the cutter blade and a cam follower, and a power gear and box cam combination driven by the motor for vertically displacing the cam follower. In operation, after a can to be opened has been loaded into the cutting mechanism without the lid being penetrated by the cutter blade, the motor is started by depression of the push button to effect rotation of the gear, the switch being held in its "closed" position by a latch even after the button is released. The cam initially forces the cam follower and therewith the slide member downwardly slightly, so that the cutter blade is forced through the lid of the can at the beginning of the cycle and is then held there while the can turns to sever the lid from the body of the can. At the end of the cycle, a rise in the cam raises the cam follower and the slide member to retract the cutter blade upwardly and thereby to release the can from the cutting mechanism and concurrently to unlatch the switch so as to enable it to return to its "open" position and open the motor energization circuit. A lightly upwardly biased, vertically movable horizontal platform is provided below the cutter blade and turning gear combination for supporting the lidless released can until it is removed by the user. This abstract is not to be taken either as a complete exposition or as a limitation of the present invention, however, the full nature and extent of the invention being discernible only by reference to and from the entire disclosure.

14 Claims, 10 Drawing Figures

Fig. 1.
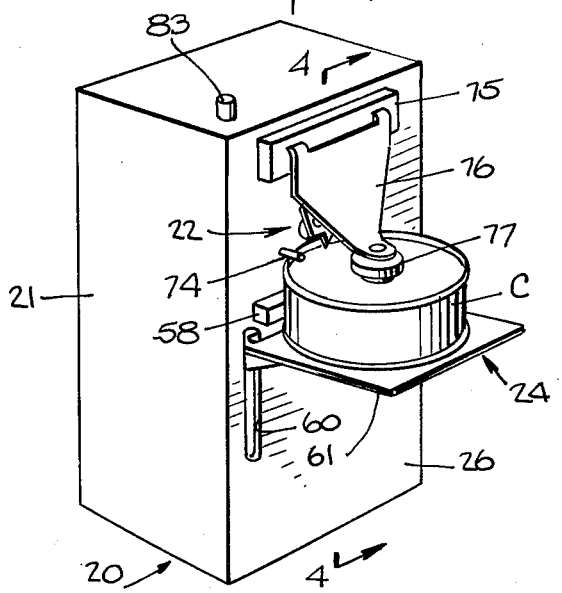
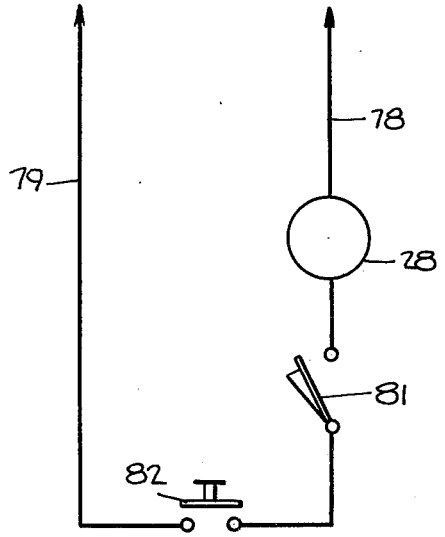
Fig. 10.
Fig. 2.
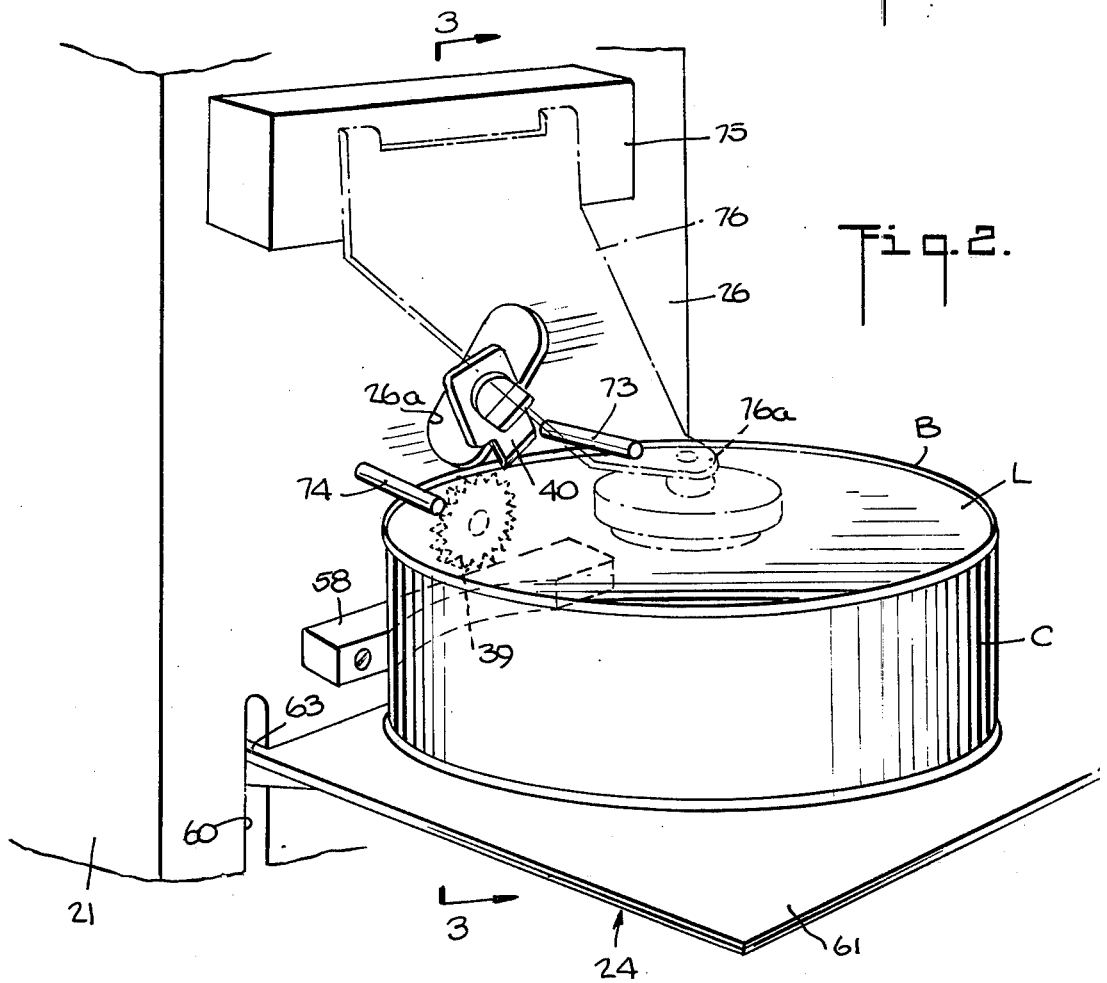

50
55
9
49
51
48
53
47c
46
54
47
26a
47a
40a
52
42
73
B
9
47b
45
43
40
37
39
77
L
C
61

52a
52b
52c
53a
55
53b
53c
51
54
52
50
53

CAN OPENER

This invention relates to can openers, and in particular to apparatus of this type adapted for use as a domestic appliance for opening hermetically sealed cans of foodstuffs or other substances.

Commercially available can openers of the class to which the present invention pertains generally have a cutting mechanism consisting of a vertically displaceable stationary or rotary cutter blade and a can-turning gear combination, with the cutter blade being arranged to be manually raised and lowered by a lever system. When desiring to use such a can opener, the user, after having positioned the lower edge of the upper bead of the sealed can in contact with the uppermost portion of the periphery of the turning gear, has to perform a number of sequential operations. First, he must manually depress the lever in order to cause the cutter blade to penetrate through the lid of the can. Second, he must manually close the "on-off" power switch of the can opener, generally by reaching to the back of the housing of the opener. Third, when the cutting operation is completed, he must again reach to the back of the housing to open the power switch. Finally, he must hold the opened can with one hand while he raises the lever with the other hand to retract the cutter blade and release the can.

It is the principal object of the present invention, therefore, to provide a novel and improved domestic can opener which will greatly simplify a can-opening operation and thus avoid some of the drawbacks and disadvantages of the aforesaid known types of can openers.

Generally speaking, the objectives of the present invention are achieved by an electric motor-driven can opener having a cooperative cutter blade and can-turning gear combination into which a sealed can of foodstuffs or other material, whether liquid, solid or paste, can be loaded so that, even with its upper peripheral bead confined between the turning gear and the cutter blade, the can may be retained in place without the cutter blade penetrating through the lid of the can. The opener further includes a switch-controlled energization circuit for the motor, means for automatically depressing the cutter blade so as to force it through the lid of the can at the start of the can-opening cycle and for automatically retracting the cutter blade from the can so as to release the latter at the end of the can-opening cycle, and a platform structure for supporting the opened and released can, minus the magnetically retained severed lid thereof, until the user is ready to take the can away from the can opener.

In the presently contemplated best mode of practicing the present invention, the means for automatically depressing and raising the cutter blade comprises a vertically reciprocatable slide member supporting both the cutter blade and a cam follower, a rotary power gear driven by the motor, and a box cam secured to and rotatable with the power gear, the cam follower being received in the groove of the box cam. The arrangement is such that when the motor starts and turns the power gear, the cam first pushes the cam follower, and therewith the slide member, downwardly slightly from their rest position determined by the tip of the cutter blade resting on the lid of the can, thereby to force the cutter blade through the lid of the can. Subsequently, after the power gear has completed one revolution, a rise in the box cam causes the cam follower, and therewith the slide member, to be raised, thereby to retract the cutter blade from the can so as to release the same. To ensure proper starting and stopping of the motor, two normally open electric switches are provided in the motor energization circuit, one being a microswitch arranged to be closed when a can to be opened is loaded into the cutting mechanism of the can opener, and the other being a master "on-off" switch arranged to be closed by a push button which must be manually depressed before the start of each cycle. A latch is provided to hold the master switch in its closed state, the latch being arranged to be automatically disengaged from the operating element of the switch by an adjunct of the slide member when the latter is raised at the end of the cutting cycle by the action of the box cam on the cam follower.

In order that the can may be released safely and in a spill-proof fashion from the cutting mechanism without the user having to be in attendance, the can opener according to the present invention is further provided with a platform structure for supporting the opened and released can. As presently contemplated, the platform structure includes a horizontal plate or platform member which is arranged for vertical reciprocal movement along the front face plate of the housing of the can opener beneath the cutting mechanism. The platform member includes a pair of rearward extensions or arms freely slidably received in a pair of vertical slots in the front face plate of the can opener, the arms carrying a pair of cylindrical bushings behind the face plate which slidably embrace and ride along a pair of fixed vertical guide rods. So that it will always be in contact with the bottom of a can being opened, the platform member is lightly resiliently biased upwardly, for example by a pair of tension or compression springs anchored at one end to the arms and at the other to a stationary adjunct of the can opener housing. Upon the can being released from the cutting mechanism, therefore, it will be securely supported by the platform structure, with the platform member sinking away from the cutting mechanism somewhat to the extent that the weight of the opened can overcomes the upward biasing force of the springs.

Among the advantages possessed by the apparatus according to the present invention are that it is simple in construction and operation and hence both inexpensive to produce and unlikely to suffer from breakdown or malfunction, that it is completely safe to operate and is reasonably proof against accidental operation even by small children inasmuch as both the microswitch and the master switch have to be closed concurrently for the motor to start, that there is no need for the user to remain in attendance during and after completion of the can-opening operation, and that although the can remains hermetically sealed until the can-opening cycle begins, there is no need for the user manually to force the cutter blade through the lid of the can.

The foregoing and other objects, characteristics and advantages of the present invention will be more clearly understood from the following detailed description thereof when read in conjunction with the accompanying drawings, in which:

FIG. 1 is a generally schematic perspective illustration of a can opener according to the present invention;

FIG. 2 is a fragmentary, enlarged detail view, in perspective, of the cutting mechanism of the can opener shown in FIG. 1, a can being shown loaded into the cutting mechanism but before the cutting operation has started;

FIG. 10 is a schematic wiring diagram of the energization circuitry for the motor of the can opener.

Figure 6:
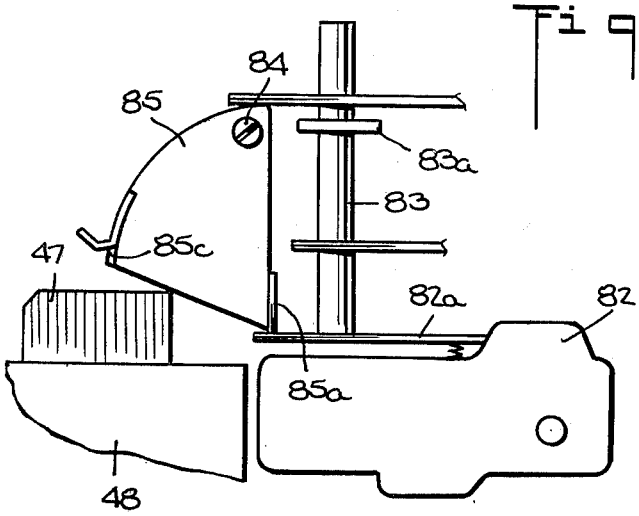
FIG. 6 is an elevational view of the push button and the latch in their active or "down" positions for holding the master switch lever in its closed or "on" position.

Referring now to the drawings in greater detail, there is shown in FIG. 1 a can opener 20 embodying the principles of the present invention. The can opener includes a housing 21 (see also FIG. 4), a cutting mechanism 22 at the front of the housing, within the latter the drive system 23 for the cutting mechanism, and at the front of the housing a platform structure 24 for supporting a can C being opened.

The housing 21 (see FIGS. 3 and 4) includes a base 25 and a rigid vertical or upright front face plate 26. Mounted in the housing by means of a suitable bracket structure 27 is an electric motor 28. The motor is shown as mounted on the face plate 26, but it may, of course, just as readily be mounted on the base 25. Suitably journaled on the face plate 26 in a bearing 29 and driven by the motor 28 (see also FIG. 5) is a gear or pinion 30 of relatively small diameter which is in mesh with a larger spur gear 31 that is rotatably supported by a horizontal bracket 32 mounted on the face plate 26. Arranged coaxially with the spur gear 31 and rotatable therewith is a small pinion 33 which meshes with a larger spur gear 34. The gear 34 and a smaller spur gear or pinion 35 are coaxially arranged on a hub 36 which is secured to one end region of a shaft 37 that is journaled in a bearing 38 secured to the face plate 26.

Figure 8:
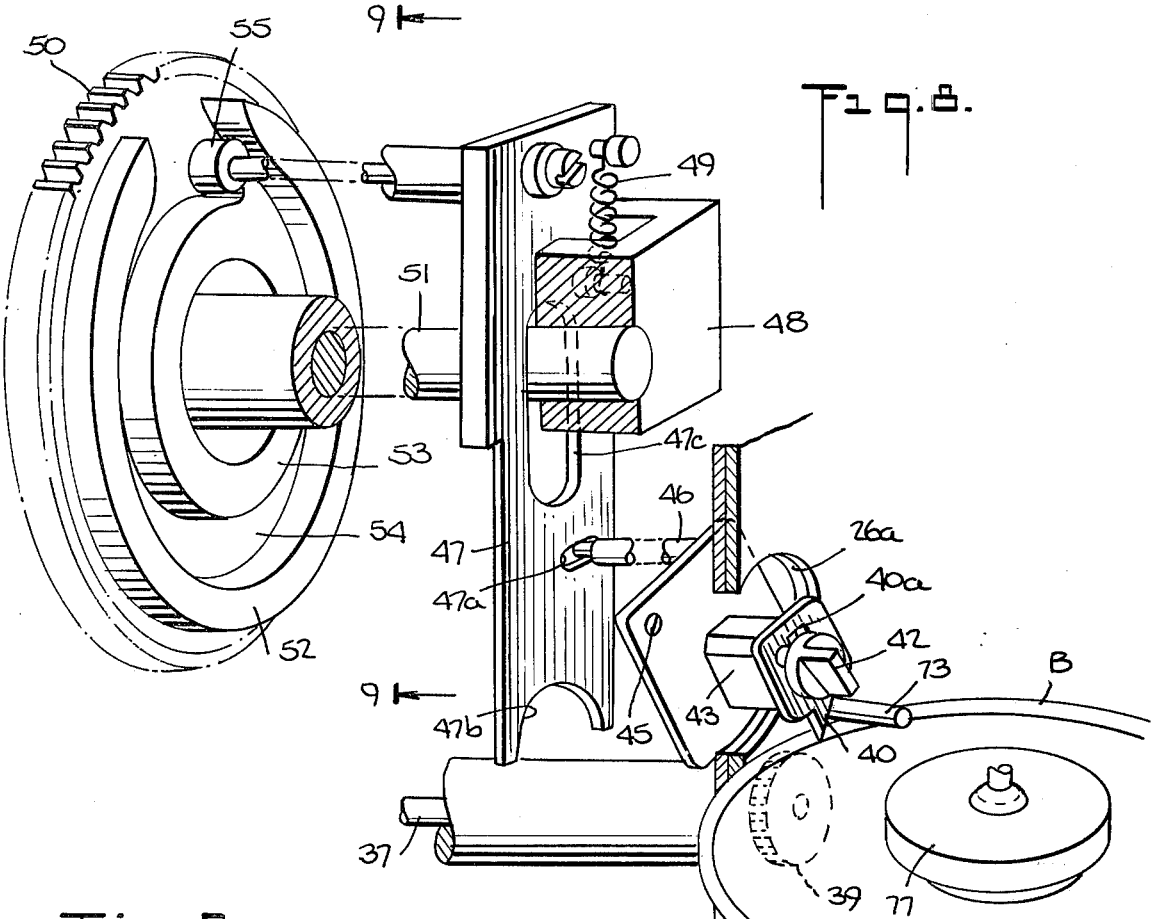
FIG. 8 is a fragmentary perspective view of the can opener with the housing and other parts removed to show details of the can-opening mechanism.

At its other end, located to the front of the face plate 26, the shaft 37 carries a knurled wheel or can-turning gear 39 of conventional construction, the toothed periphery of which is engageable in usual fashion with the underside of the upper peripheral bead B of a can C to be opened. The gear 39 is a part of the cutting mechanism 22 of the can opener and for that purpose is juxtaposed to a cutter blade 40 (see also FIG. 8) located frontwardly of the face plate 26. The cutter blade 40 as shown is a straight-edged non-rotating element (although it could be a rotary wheel-type cutter just as well), and it is adjustably affixed, by means of a screw or bolt 41 having a knob-like head 42 and extending through a slot 40a in the body of the blade, to an arm or similar adjunct 43 of a plate 44. The plate 44 is located just rearwardly of the face plate 26 and is pivotally mounted on the latter at 45 for swinging movement in a vertical plane, the arm 43 extending through an elongated, slightly arcuate, slot or opening 26a provided in the face plate 26. By manipulating the knob or head 42, therefore, the cutter blade can be manually raised and lowered relative to the can-turning gear 39.

The can opener also includes means for raising and lowering the cutter blade automatically. To this end, the plate 44 is linked by a rearwardly extending arm or pin 46 to a plate-shaped slide member 47, the latter having a small transverse slot **47*a* therein to accommodate the end of the arm 46. The slide member 47 is constrained to vertical reciprocal movement by a suitable guide and bearing bracket structure 48 secured to the face plate 26 and defining a planar space 48*a* for accommodating the slide member. A tension spring 49 (shown in FIG. 8 only) anchored at its lower end to the bracket structure 48 and at its upper end to the slide member biases the latter and thereby the cutter blade downwardly. To avoid interference with such downward movement by the bearing 38, the slide member is arcuately recessed at 47*b***.

Arranged opposite the rear face of the slide member 47 is a large power gear 50 which is rotatably mounted on a shaft 51 journaled in the bearing and guide bracket structure 48, the slide member 47 having a vertical slot **47*c* to accommodate the shaft 51. The gear 50 is in mesh with the small spur gear 35. On its front face, the gear 50 carries a box cam constituted by a pair of generally concentric rails 52 and 53 defining a cam groove 54 therebetween (see also FIG. 9). The outer cam rail 52 is interrupted to provide a gap 52*a* between two outwardly rising portions 52*b* and 52*c* of the inside surface of the rail 52. In the region of the gap 52*a*, the inner cam rail 53 is provided with a rise 53*a* providing at one side of the latter an outwardly rising portion 53*b* of its outside surface opposite the rising surface portion 52*b* of the outer rail 52, and providing at the other side of the rise 53*a* an arcuate dropping portion 53*c* opposite the surface portion 52*c* of the outer rail. The box cam 52-53-54 cooperates with a cam follower 55 carried by the slide member 47 adjacent the upper end thereof. In the illustrated embodiment, the cam follower 55 is in the form of a small roller secured to a shaft 56 rotatably journaled in a tubular bearing 57 fixed to the slide member 47 in any suitable manner, the roller having a diameter just slightly less than the width of the groove 54 in the region of its constant width so as to fit smoothly slidably into the groove 54. The arrangement of the parts is such that whenever the cam follower roller 55 is located within and riding along the confines of the constant width portion of the groove 54, the slide member 47 is held (with no more than minimal play) in its downwardmost position so that thereby the cutter blade 40 is held in its downwardmost position relative to the can-turning gear 39 and with its cutting edge below the level of the lid L of a can C being opened. When the cam follower roller 55 is located at the rise 53*a* of the inner cam rail 53, the slide member 47** is raised and the cutter blade is thereby also raised and retracted out of its operating position.

Fixed to the front side of the face plate 26 below the can-turning gear 39 is a concavely contoured abutment bar 58 the purpose of which is to ensure that the can C to be opened is properly positioned with respect to the cutting mechanism. Below the level of the abutment bar 48, the face plate 26 is further provided with a pair of spaced vertical guide slots 59 and 60 (FIGS. 1, 2 and 5) which are straddled by the horizontal platform member 61 of the platform structure 24. The platform member 61 has a pair of suitably braced rearward extensions or arms 62 and 63 which are freely slidably received in the guide slots 59 and 60, respectively. To the rear of the face plate 26, the arms 62 and 63 carry respective cylindrical guide bushings 64 and 65 which slidably embrace and ride along a pair of stationary vertical guide rods 66 and 67 secured at their upper ends to a bracket member 68 and at their lower ends to a pair of bracket members 69 and 70, all secured to the back side of the front face plate 26. The platform member is lightly biased upwardly by means of a pair of tension springs 71 and 72 anchored at one end to the bracket 68 and at the other end to the brackets 69 and 70, respectively. By this arrangement, the platform member 61 will be maintained, even during a cutting operation, in engagement with the bottom of a can C held in the cutting mechanism, but this will not offer any appreciable frictional resistance to the turning of the can during the cutting operation, and such resistance could be even further minimized by the use of a suitable anti-friction coating surface on the platform member 61.

Adjacent the cutting mechanism 22 there are provided on the face plate 26 two can-leveling abutment pins 73 and 74 (see FIGS. 1, 2 and 8), and above the mechanism a bracket 75 (see FIGS. 1, 2 and 4) which removably supports in any suitable manner an arm 76 to the lowermost end section 76a of which a permanent magnet 77 is swivelly connected. The arrangement is such that when a can C to be opened is in position in the cutting mechanism, the pins 73 and 74 engage the bead B of the can from above and the magnet 77 rests medially on the lid of the can and is magnetically attracted thereto. By virtue of its connection to the arm section 76*a*, the magnet 77 will rotate with the can during the cutting operation, but that is not essential.

The can opener 20 according to the present invention is further provided with an energization circuit (see FIG. 10) for the motor 28. The circuit, which is shown schematically only, is connected with a suitable source of power, e.g. the standard 115 volt, 60-cycle house current line 78–79, via a standard electric power cord 80 (see FIG. 5) and further includes a normally open microswitch 81 and a normally open master switch 82 both connected in series with the motor 28. The microswitch 81 is mounted on the rear side of the face plate 26, advantageously behind the can-positioning abutment bar 58 (see FIGS. 3 and 4), and has a switch-operating element 81*a* extending through an opening 26*b* in the face plate 26 to a point where a small roller 81*b* carried by the element 81a will be engaged, with sufficient force to displace the latter into its switch-closing state, by a properly positioned can C. The master switch 82, on the other hand, is mounted in the upper region of the face plate 26 and has an operating element 82*a* which is biased to its switch-opening state by a small spring 82*b*. The element 82*a* adjacent its free end bears against the lowermost tip of a plunger or push button 83 the top end region of which protrudes above the top of the housing 21 (see FIGS. 1 and 5), upward movement of the push button or plunger 83 beyond a certain point being inhibited by a flange or washer 83a secured to the plunger intermediate its ends. Depression of the push button thus will close switch 82. The electrical interconnections between the motor 28 and the switches 81 and 82 are also shown in broken lines in FIG. 5.

Figure 7:
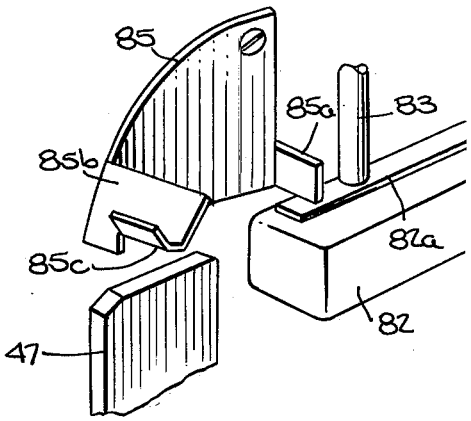
FIG. 7 is a fragmentary perspective view of the structure shown in FIG. 6 and illustrates details of the latch for the switch-operating lever.
Figure 5:
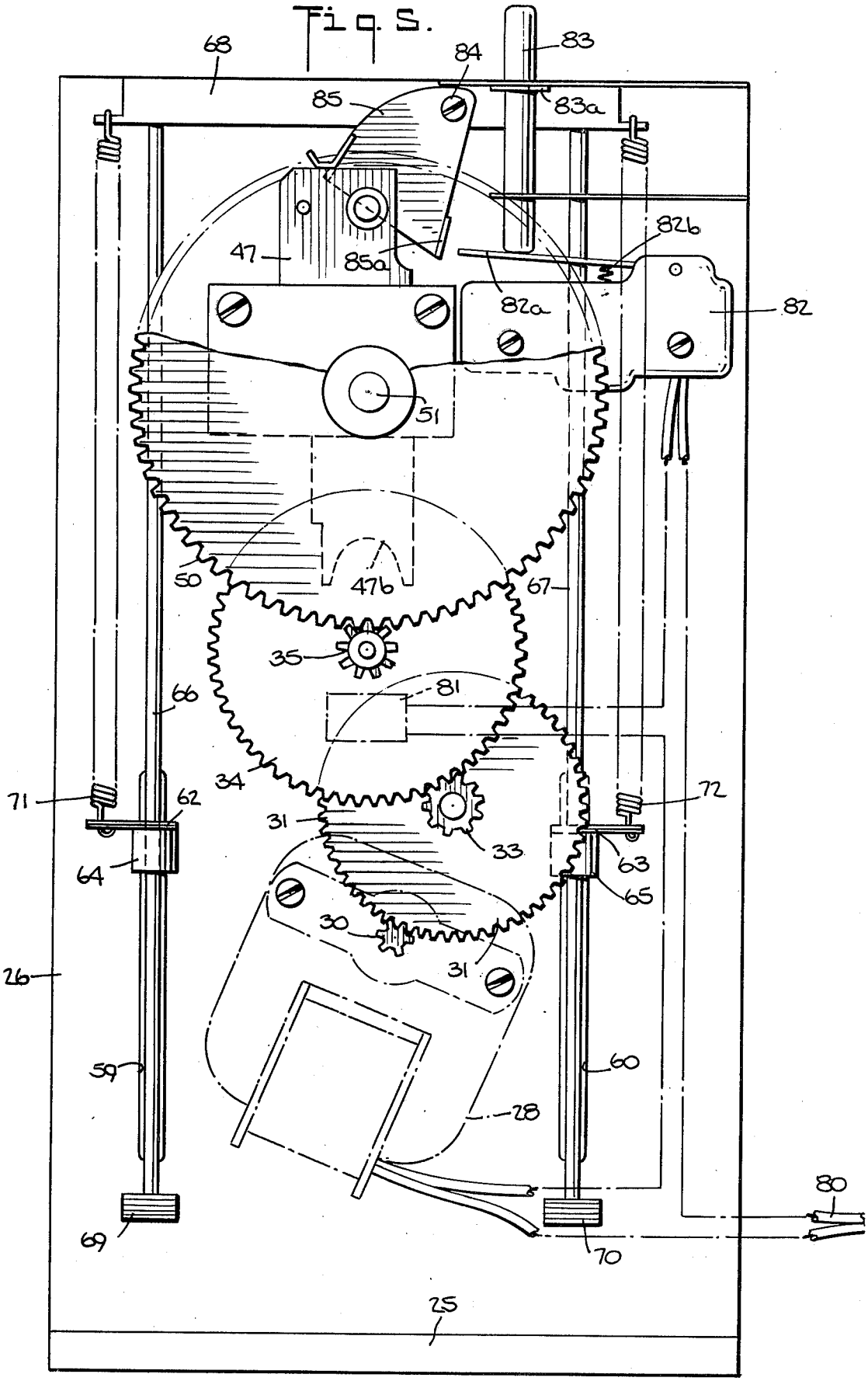
FIG. 5 is a rear elevational view of the can opener with the back of the housing removed to show details of the gear drive for the cutting mechanism and the platform bearing arrangement, the operating lever of the motor starting or master switch being shown unlatched and in its open or "off" position, and the push button for the switch being shown in its inactive or "up" position.

Pivotally mounted on the back side of the face plate 26 at 84 adjacent the plunger 83, for swinging movement in a vertical plane parallel to the face plate 26, is a latch member 85 (see FIGS. 5, 6 and 7). The latch member is shown as being in the form of a generally triangular segment-shaped plate having a transversely extending lug 85*a* at one of its free corners and a transversely extending lug 85*b*, partly cut and bent upwardly so as to define a cam surface 85*c*, at its other free corner. When the switch-operating element 82*a* is in its "up" position and the slide member 47 is in its downwardmost position, the lug 85*a* rests against the free edge of the switch element. On the other hand, when the push button 83 is depressed to move the element 82*a* to its "down" position, the latch member 85, under its own weight and because of the location of its pivot point, swings downwardly (counterclockwise as seen in FIGS. 6 and 7) and brings the lug 85*a* into a position where it extends across the top of the element 82*a*, thereby preventing upward movement of the latter and keeping the switch 82 closed. Thereafter, when the slide member 47 is raised, it (or an adjunct thereof) engages the cam surface 85*c* of the latch member 85 and swings the latter upwardly (in a clockwise direction as seen in FIGS. 6 and 7) so as to retract the lug 85*a* from the switch-operating element 82*a* and permit the latter to move upwardly under the force of the spring 82*b* so as to open the switch 82.

When the can opener 20 is to be used, a still sealed can C of food or other material to be dispensed is loaded into the cutting mechanism 22. To this end, the box cam 52-53-54 must be in the position shown in FIGS. 8 and 9, so that the cam follower roller 55 is located in the region of the gap 52*a* of the outer cam rail 52 and preferably adjacent the dropped portion 53*c* of the outer surface of the inner cam rail 53. In the loading operation, the cutter blade 40 is first raised manually through the intermediary of the knob 42, which also raises the slide member 47 and results in the latch member 85 being swung over to the position shown in FIG. 5, and the can is then fitted against the abutment bar 58 and the gear 39 so as to have the upper bead B of the can resting on the knurled surface of the gear 39. Finally, the cutter blade is lowered again until the tip of its cutting edge rests on, but does not penetrate through, the lid L of the can (see FIGS. 2 and 3). This in conjunction with the tilt-inhibiting action of the pins 73 and 74 serves to hold the can steady in the cutting mechanism, with the bottom of the can engaged by the platform member 61 of the platform structure 24 under the action of the springs 71 and 72.

With the magnet 77 resting on the lid of the can, the electric cord 80 is plugged into a wall socket and the push button 83 is depressed. As will be apparent from the circuit diagram of FIG. 10, the motor will then be energized and started, because both the switches 81 and 82 are closed, the former because the body of the can is pressed against the roller 81*b*, and the latter because its operating element 82*a* is held in its "down" position (shown in FIG. 6) by the latch member 75.

Figure 3:
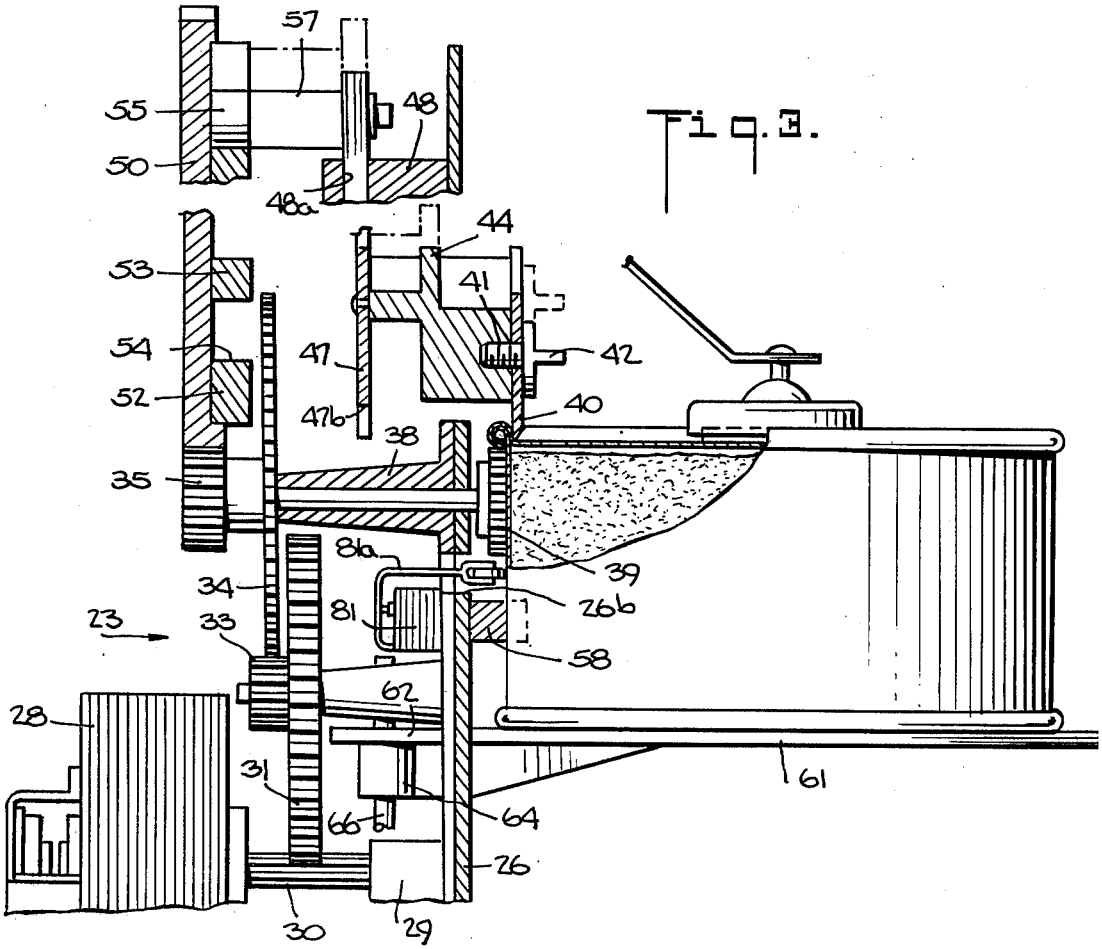
FIG. 3 is a fragmentary sectional view taken along the line 3—3 in FIG. 2.
Figure 9:
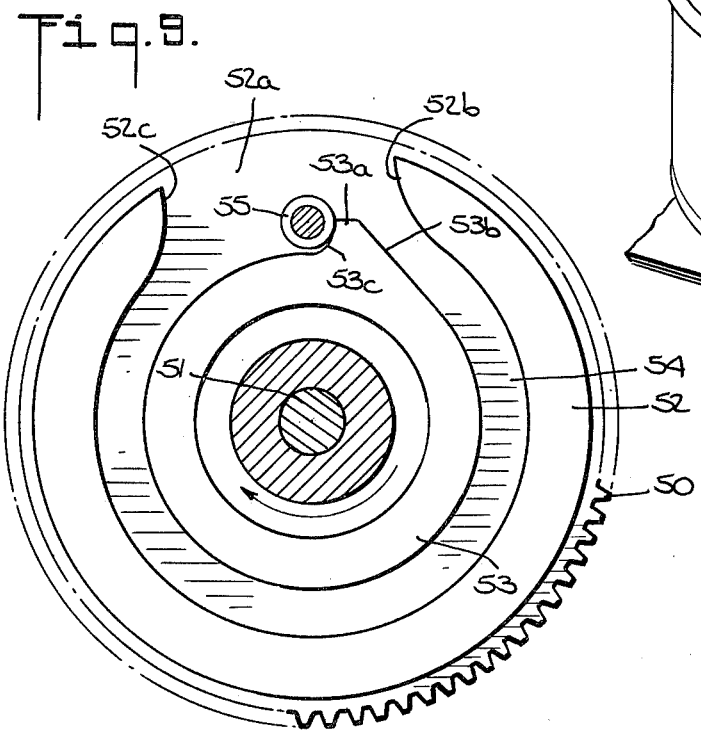
FIG. 9 is a sectional view taken along the line 9—9 in FIG. 8 and shows the power gear and box cam arrangement from the front.

Through the intermediary of the gear train 30-31-33-34, therefore, the can-turning gear 39 is set into rotation to begin revolving the can around its axis. At the same time, the power gear 50 is set into rotation, in the direction of the arrow shown in FIG. 9, through the intermediary of the gear train 30-31-33-34-35. During the initial part of this movement of the power gear, while the cam follower roller 55 is still in the region of the gap 52*a* of the cam rail 52, the tip of the cutter blade 40 rides along the top surface of the lid of the can and the cam follower roller is raised somewhat from the outer surface of the inner rail 53, as shown in FIGS. 3 and 9.

Figure 4:
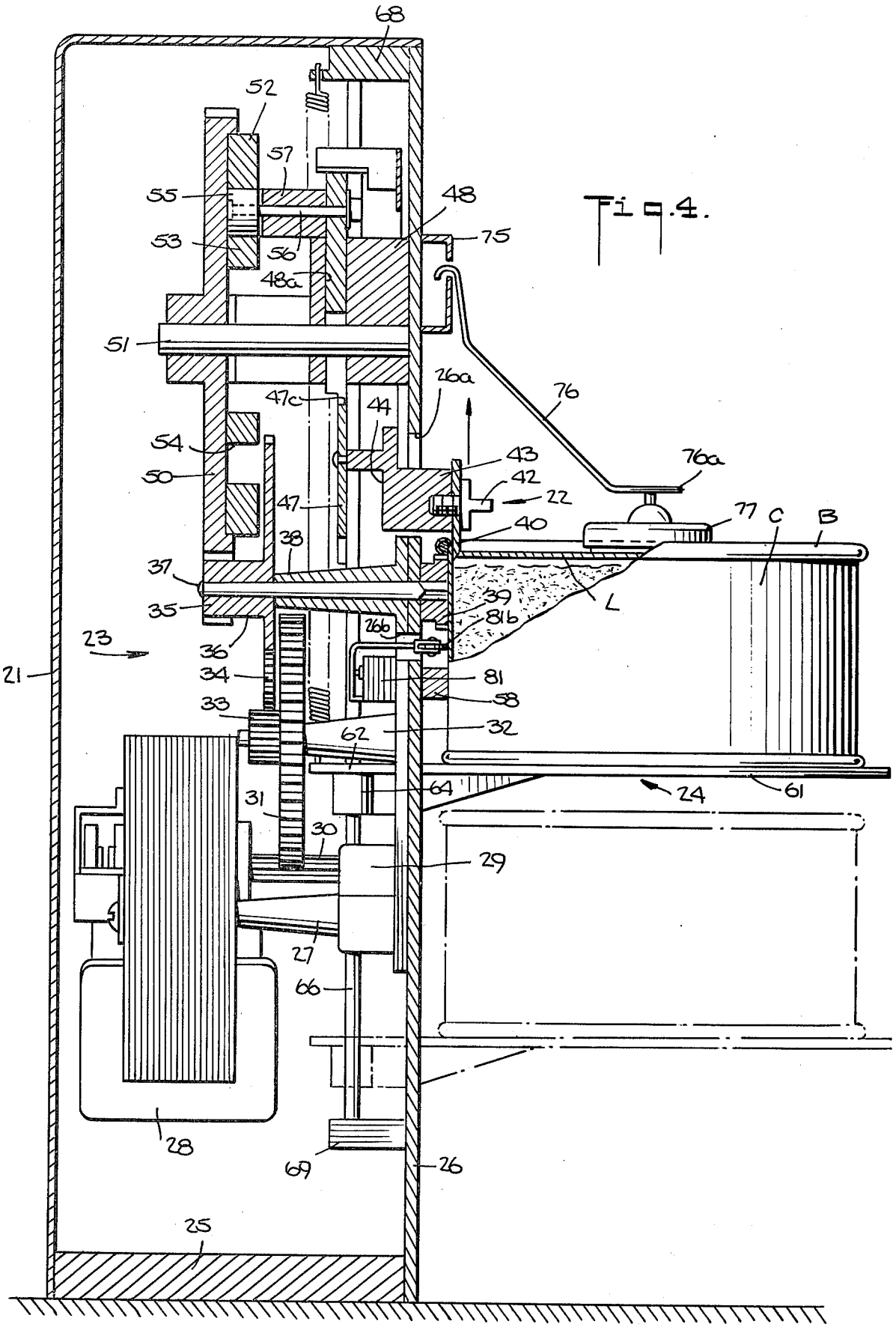
FIG. 4 is a sectional view taken along the line 4—4 in FIG. 1 and shows the can during a cutting operation, the lowered position of the can on the supporting platform at the end of the cutting operation being indicated in phantom outline.

When the surface portion 52*c* of the outer cam rail 52 reaches the location of the cam follower roller 55, however, it engages the latter and forces it downwardly, which displaces the slide member 47 to its downwardmost position and thereby forces the cutter blade downwardly so as to cause it to penetrate through the lid of the can, as shown in FIG. 4. As the rotation of the can then continues, the lid is severed from the can. The gear ratios are, of course, so chosen that the can will have completed at least slightly more than one full revolution (to ensure complete severing of the lid of the can) before the power gear has rotated sufficiently to bring the portion of the groove 54 just preceding the rise 53*a* of the inner cam rail 53 to the location of the cam follower roller 55.

As the power gear then continues to rotate, the cam follower roller is displaced upwardly between the rising surface portions 52*b* and 53*b* of the cam rails 52 and 53. The slide member 47 thus is raised and causes the cutter blade 40 to be retracted from in front of the upper bead B of the can. This releases the can and permits it, minus its severed lid which is retained by the magnet 77, to sit freely with its full weight on the platform member 61. The strength of the biasing springs 71 and 72 is so chosen that when the can is released, the platform member will sink somewhat under the weight of the can until it comes to rest either in an equilibrium position intermediate the top and bottom ends of the slots 59 and 60 or upon arrival of the arms 62 and 63 at the bottom ends of the slots.

As the cam follower 55 reaches the top of the rise 53*a* of the inner cam rail 53, the slide member 47 engages the cam surface 85*c* of the latch member 85 and swings it upwardly so as to withdraw the lug 85*a* from the operating element 82*a* of the master switch 82. The latter thus is opened at just about the same time as the microswitch 81 is opened when the can C leaves the cutting location, whereby the energization circuit for the motor 28 is broken. By virtue of the inertia inherent in the system, however, the power gear will continue to rotate somewhat, to a degree sufficient to move the cam rise 53*a* past the cam follower roller 55 and to permit the latter to drop down onto the outer surface portion 53*c* of the inner cam rail 53. Although ordinarily it will not be necessary, if it is found that this after movement is so great as to cause the cam surface portion 52*c* of the outer cam rail to reach the location of the roller 55, a suitable electromagnetic brake adapted to act on the power gear 50 when the motor is deenergized may be incorporated in the system.

It will be apparent from the foregoing that once the user has depressed the push button 83, no further supervision of the can opener is required, as the opening operation will terminate automatically and the opened can will remain seated securely on the platform member 61 until removed therefrom by the user, with the severed lid being retained by the magnet 77. The safety features of the can opener especially for small children will also be recognized, since there is no way the opener can get started unless the microswitch 81 is closed at the time as the master switch 82. Moreover, the sensitivity of the microswitch is such that once the opened can has been released, the can opener cannot be started up again, even if the push button 83 were to be depressed, until another can has been loaded into the cutting mechanism.

The present invention thus is seen to provide a can opener which, in its broadest sense, includes a cutter blade mounted for reciprocal movement into and out of a cutting location, motor means for revolving a can to be opened when the can is disposed at the cutting location, power means operable conjointly with the motor means for sequentially forcing the cutter blade through the lid of the can concomitantly with the revolving thereof and, after the lid has been severed, retracting the cutter blade from the can to release the latter, and a platform structure for yieldingly supporting the opened can upon release thereof and permitting it to remain at a location somewhat below the cutting mechanism until removed therefrom by the user. In a particularly advantageous refinement of the invention, the power means comprises cam and cam follower means operated by the motor means for effecting the aforesaid actions of the cutter blade as well as the subsequent deactivation of the motor means concurrently with the release of the can.

It will be understood that the foregoing description of a preferred embodiment of the present invention is for purposes of illustration only, and that the various herein disclosed structural and operational features and relationships are susceptible to a number of modifications and changes none of which entails any departure from the spirit and scope of the present invention as defined in the hereto appended claims. Merely by way of example, the cutter blade could be a rotary element rather than a stationary one as shown. The gear and cam combination for forcing the cutter blade down and retracting it up could be replaced by a solenoid operator suitably connected into the motor energization circuit and acting on the blade-holding slide member. Still other variations will readily suggest themselves to those skilled in the art.

What I claim is:

1. A can opener for use with hermetically sealed cans of foodstuffs and other materials, comprising a cutter blade mounted for reciprocal movement into and out of a cutting location, motor means for revolving a can to be opened when the same is disposed at said cutting location, power means operable conjointly with said motor means for sequentially reciprocally displacing said cutter blade so as to first force said cutter blade through the lid of said can concomitantly with the revolution thereof and, after the lid has been severed, then retract said cutter blade from said can to release the latter, and a platform structure for yieldingly supporting the opened can upon release thereof and for displacing it away from said cutting location while retaining it secure until removed by the user.

2. A can opener according to claim 1, further comprising master switch means operable manually to permit activation of said motor means and operable automatically in response to the retraction of said cutter blade for deactivating said motor means.

3. A can opener according to claim 2, wherein said motor means comprises an electric motor and an energization circuit therefor, and said master switch means comprises a normally open first switch connected in said energization circuit, push button means for closing said first switch, releasable latch means operable when engaged for holding said first switch closed, and means connected with said cutter blade for releasing said latch means upon retraction of said cutter blade.

4. A can opener according to claim 3, further comprising a normally open second switch connected in said energization circuit and arranged to be closed by said can when the same is disposed at said cutting location.

5. A can opener according to claim 1, wherein said power means comprises cam and cam follower means.

6. A can opener according to claim 1, wherein said power means comprises gear means driven by said motor means, cam means operated by said gear means, and reciprocally movable cam follower means connected with said cutter blade and responsive to said cam means for effecting the reciprocal displacements of said cutter blade.

7. A can opener according to claim 6, further comprising a reciprocally movable slide member carrying said cutter blade, and wherein said gear means includes a power gear, said cam means includes a box cam carried by said power gear at one face thereof and defining a circumferentially extending cam groove which is of constant radial width and concentric with said power gear over substantially the entire extent of said groove but has a radially outwardly rising portion at a circumferentially relatively small region along its length, and said cam follower means includes a roller carried by said slide member and received in said groove of said box cam, said roller having a diameter only slightly smaller than the radial width of said groove.

8. A can opener according to claim 7, further comprising master switch means operable manually when said rising portion of said groove of said box cam is not at the location of said roller to permit activation of said motor means and operable automatically in response to movement of said rising portion of said groove past said roller and the resultant retraction of said cutter blade for deactivating said motor means.

9. A can opener according to claim 8, wherein said motor means comprises an electric motor and an energization circuit therefor, and said master switch means comprises a normally open first switch connected in said energization circuit, push button means for closing said first switch, releasable latch means operable when engaged for holding said first switch closed, and said slide member having an adjunct thereof operable when raised by said roller for displacing said latch means out of its engaged state upon retraction of said cutter blade, said latch means being movable to said engaged state only upon said roller being in a portion of said groove other than said rising portion and upon depression of said push button means.

10. A can opener according to claim 9, further comprising a normally open second switch connected in said energization circuit and arranged to be closed by said can when the same is disposed at said cutting location.

11. A can opener for use with hermetically sealed cans of foodstuffs and other materials, comprising an electric motor-driven can-turning gear, a cooperating retractable cutter blade juxtaposed to said can-turning gear, the latter and said cutter blade jointly constituting a cutting mechanism for opening a sealed can loaded thereinto and being operable to retain a sealed can at the cutting location without penetration of the can lid by said cutter blade, microswitch means responsive to a can being loaded into said cutting mechanism for conditioning the motor energization circuit to enable ultimate energization thereof, power means operable conjointly with the motor, when the same is energized, for sequentially forcing said cutter blade through the can lid, holding it there as the can revolves to effect the severing of the lid, and retracting it from the fully opened can to release the same and simultaneously effect the deenergization of the motor, a platform structure for yieldingly supporting the opened can upon release thereof from said cutting mechanism and including a platform member normally biased toward the cutting location and movable away therefrom under the weight of the opened can for displacing the latter away from the cutting location and said microswitch means, and master switch means operable manually to permit energization of said motor energization circuit upon conditioning thereof by said microswitch means and operable automatically in response to retraction of said cutter blade from said can-turning gear for deenergizing said motor energization circuit.

12. A can opener according to claim 11, wherein said power means comprises a gear-driven cam and an associated cam follower for effecting the sequential actions of the cutter blade as well as the opening of said motor energization circuit concurrently with the release of the can.

13. A can opener according to claim 11, wherein said power means includes a power gear driven by said motor, a box cam carried by said power gear at one face thereof and defining a circumferentially extending cam groove which is of constant radial width and concentric with said power gear over substantially the entire extent of said groove but has a radially outwardly rising portion at a circumferentially relatively small region along its length, and a cam follower connected with said cutter blade and received in said groove of said box cam for following the contours thereof to effect the sequential actions of said cutter blade as well as the opening of said motor energization circuit concurrently with the release of the can.

14. A can opener according to claim 13, wherein a reciprocally movable slide member carries said cutter blade and said cam follower, said master switch means comprises a normally open master switch connected in said motor energization circuit, a push button for closing said master switch, and a releasable latch member operable when in a first position for holding said master switch closed and operable when in a second position for permitting said master switch to open, said latch member being arranged for movement from said second position to said first position upon depression of said push button and only upon said cam follower being in a portion of said groove other than said rising portion thereof, and said slide member has an adjunct thereof operable, when moved by said cam follower so as to retract said cutter blade, for displacing said latch member from said first to said second position thereof upon retraction of said cutter blade.

* * * * *